US006314339B1

(12) United States Patent
Rastegar et al.

(10) Patent No.: US 6,314,339 B1
(45) Date of Patent: Nov. 6, 2001

(54) METHOD AND APPARATUS FOR OPTIMIZING AN ACTUAL MOTION TO PERFORM A DESIRED TASK BY A PERFORMER

(75) Inventors: Jahangir S. Rastegar, Stony Brook, NY (US); Michael Mattice, Picatinny Arsenal, NJ (US)

(73) Assignee: The Research Foundation of State University of New York, Albany, NY (US)

( * ) Notice: Subject to any disclaimer, the term of this patent is extended or adjusted under 35 U.S.C. 154(b) by 0 days.

(21) Appl. No.: 09/165,331

(22) Filed: Oct. 1, 1998

Related U.S. Application Data

(60) Provisional application No. 60/060,620, filed on Oct. 1, 1997.

(51) Int. Cl.[7] ..... G05B 15/00; G05B 19/00

(52) U.S. Cl. ..... 700/260; 700/245; 700/263; 607/48; 607/49; 607/59; 607/60; 607/61; 607/62; 600/561

(58) Field of Search ..... 700/245, 260, 700/263; 607/48, 49, 59, 60, 61, 62; 600/561

(56) References Cited

U.S. PATENT DOCUMENTS

| | | | | |
|---|---|---|---|---|
| 5,078,152 | | 1/1992 | Bond et al. | 600/587 |
| 5,167,229 | * | 12/1992 | Peckham et al. | 607/48 |
| 5,421,798 | | 6/1995 | Bond et al. | 601/23 |
| 5,776,171 | * | 7/1998 | Peckham et al. | 607/48 |
| 5,818,359 | * | 10/1998 | Beach | 700/260 |
| 5,823,878 | | 10/1998 | Welch | 463/43 |
| 5,835,693 | * | 11/1998 | Lynch et al. | 345/473 |
| 6,026,328 | * | 2/2000 | Peckham et al. | 607/48 |

OTHER PUBLICATIONS

Huang et al., A Computer–Controlled Electrimechanical Hammer To Quantify Tendon Reflex, IEEE., pp. 2242–2245, 1997.*

Gabriel et al., Qualitative Morphological Analysis Of Muscle Biopsies Using Neural Networks, IEEE, pp. 943–946, 1993.*

Fujita et al., Analysis Of Fes–Induced Upper Limb Motion For Machine Learning Control, IEEE., pp. 445–446, 1997.*

Lin et al., Biomechanical Factors Determining Postural Stability At The Elbow Joint, IEEE., pp. 424–425, 1994.*

Milburn, P.D., "Summation of Segmental Velocities in the Golf Swing", Medicine and Science in Sports and Exercise, 14, No. 1, pp. 60–64 (1982).

Winter, D.A., Biomechanics of Human Movement, Wiley–Interscience Series, John Wiley & Sons (1979).

* cited by examiner

*Primary Examiner*—William A. Cuchlinski, Jr.
*Assistant Examiner*—McDieunel Marc
(74) *Attorney, Agent, or Firm*—Scully, Scott, Murphy & Presser

(57) ABSTRACT

A method for optimizing an actual motion to perform a desired task by a performer wherein the performer has joints connected to body parts, the joints being actuated by muscle forces resulting in body part motion and the actual motion occurring as a result of generated muscle forces which torque the joints, resulting in the actual motion of connective body parts and/or an implement connected thereto. The joints, body parts, implements and their physical characteristics making a dynamic system. The method comprises the steps of deriving dynamics equations relating muscle forces to the dynamic behavior of the dynamic system; and computing the optimal motion for performing the desired task by minimizing the higher harmonic content of the muscle forces.

13 Claims, 12 Drawing Sheets

METHOD AND APPARATUS FOR OPTIMIZING AN ACTUAL MOTION TO PERFORM A DESIRED TASK BY A PERFORMER

CROSS REFERENCE TO RELATED APPLICATIONS

This application is a conversion of U.S. provisional application Ser. No. 60/060,620 filed on Oct. 1, 1997.

BACKGROUND OF THE INVENTION

1. Field of the Invention

The field of art to which this invention relates is optimization of human physical performance, and more particularly to methods and apparatus for improving human physical performance as it relates to training for athletic activities, preventing injury, and physical therapy.

2. Description of the Related Art

Motion analysis systems are known in the art. They typically comprise a combination of hardware and software which records a physical motion, such as a golf swing, typically in slow motion. The motion is then subjectively analyzed by an expert in that particular motion, such as a golf pro, who then offers advice, based upon his own experience with the motion, on how to optimize or improve the motion.

While these systems are useful, they suffer from several disadvantages. They are typically complex and costly, a large part of the cost being the labor of the expert. However, the greatest disadvantage is their subjectiveness. Different experts may very well offer differing advice on how to optimize the motion.

For these reasons, there is a need in the art for a simple, inexpensive, and objective method and apparatus for optimizing the performance of an actual motion to perform a desired task.

SUMMARY OF THE INVENTION

Therefore, it is an object of the present invention to provide a simple and inexpensive method and apparatus for optimizing an actual motion to perform a desired task by a performer.

It is yet another object of the present invention to provide an objective method and apparatus for optimizing an actual motion to perform a desired task by a performer.

Based on years of research in the area of high speed robot dynamics and ultra high performance motion planning for robots and recent studies of the dynamics of human motion in sport activities such as in tennis and golf by expert players, a method useful for training athletes to maximize their performance is disclosed. However, the method of the present invention can be used to optimize many human physical motions, not just those involved in sports.

Briefly, the present invention shows that the maximum performance by an athlete, for example, in striking a tennis ball during serving or striking a golf ball or a baseball with the maximum possible speed is dependent on the geometry of the athlete's limbs, the maximum force that he/she can generate by his/her muscles, and the motion pattern with which he/she executes the task. The novelty of the present invention is based upon the highly complex and nonlinear dynamics of motion. A novel method is disclosed that given the approximate physical characteristics of an athlete, optimal achievable motions that would maximize the performance can be determined. The information can then be used to visualize and quantify motion modifications that can lead to better performance, to determine which muscles or groups of muscles should be strengthened for maximum gain in performance, and/or to determine the necessary modifications to the motion pattern to reduce the chances of short term and long term injuries, etc. A number of devices for the purpose of sensing the actual motions and providing real time feedback to the athlete during his/her training are also provided in the present invention.

Accordingly, a method for optimizing an actual motion to perform a desired task by a performer is disclosed. The performer having joints connected to body parts. The joints being actuated by muscle forces resulting in body part motion. The actual motion occurring as a result of generated muscle forces which torque the joints, resulting in the actual motion of connective body parts and/or an implement connected thereto. The joints, body parts, implements and their physical characteristics comprise a dynamic system. The method comprises the steps of deriving dynamics equations relating muscle forces to the dynamic behavior of the dynamic system; and computing the optimal motion for performing the desired task by minimizing the higher harmonic content of the muscle forces.

A preferred method for optimizing and correcting the actual motion comprises a first step of performing the actual motion to be analyzed in which each joint in the dynamic system participates in an actual motion. A second step of recording the actual motion is performed simultaneously with the first step. A third step of analyzing the actual motion by measuring the joint angles and absolute joint positions as a function of time is next performed. However, the second step is not essential to practicing the invention since the third step can be done in real time instead of from the recorded actual motion. The analyzed actual motion is then converted into a numerical representation of joint angle and absolute joint position versus time for each joint in the dynamic system in a fourth step. The numerical representation is then extended to form a full period of motion in a fifth step. Alternatively, the in numerical representation is stored for later use. The extended numerical representation is then analyzed in a sixth step to determine the harmonic content for the full period of motion. In a seventh step, dynamics equations are then derived which relate muscle forces to the dynamic behavior of the dynamic system according to the equations of motion. Muscle forces are then computed for the full period of motion using the equations of motion in an eighth step. The optimal motion for performing the desired task is then computed in a ninth step by minimizing the higher harmonic content of the muscle forces. The actual motion is then compared to the optimal motion (or that part of the optimal motion corresponding to the un-extended portion of the full period of motion, namely, the actual motion) in a tenth step. Alternatively, a feedback to the performer is generated in which the performer is instructed and/or prompted on how to modify the actual motion and/or system dynamics in order to more closely achieve the optimal motion.

Another aspect of the present invention is an apparatus for optimizing an actual motion to perform a desired task by a performer. The apparatus comprising a means for analyzing the actual motion to determine the joint angles and absolute joint positions as a function of time for each joint in the dynamic system, a computing means for converting the analyzed actual motion into a numerical representation of joint angle and absolute joint position versus time for each joint in the dynamic system, for extending the numerical representation to form a full period of motion, for analyzing the extended numerical representation to determine the harmonic content for the full period of motion, for computing muscle forces for the full period of motion using dynamic equations of motion, for computing the optimal motion for performing the desired task by minimizing the higher harmonic content of the muscle forces, and for comparing the actual motion to the corresponding segment of the optimal motion. Alternatively, the computing means also generates a feedback signal instructing and/or prompting the performer how to modify the actual motion and/or system dynamics in order to more closely achieve the optimal motion.

The apparatus also preferably comprises a feedback device receiving the generated feedback signal from the computing means for generating modification forces to at least one of the joints in the dynamic system while performing an actual motion for more closely obtaining the optimal motion and an output device, such as a monitor, for superimposing an optimal motion over the actual motion.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENTS

In previous studies, it has been shown that robot arms can perform higher speed operations when their motion is synthesized for joint torques with low harmonic content. The limitation on the harmonic content of the torques are due to the dynamic response limitations of the motors and the nonlinear nature of the dynamics of robot arms. In the present invention, this concept has been extended to human motions, in particular, athletic motions. In these motions, the motion at the shoulder and the wrist of expert golfers during striking swings and the required shoulder and wrist muscle generated torques were analyzed for their harmonic contents. The results show that a good swing is the result of shoulder and wrist motion patterns that consist almost entirely of one fundamental sinusoidal time function and its first two harmonics. The required shoulder and wrist torques also consist of the three harmonics in the joint motion with negligible higher harmonics content. The results confirm the hypothesis that optimal golf swing motions, and other similar athletic motions such as swinging a baseball bat or a tennis racket, consist of low harmonic patterns that are synthesized to require joint torques with low harmonic content.

Figure 1:
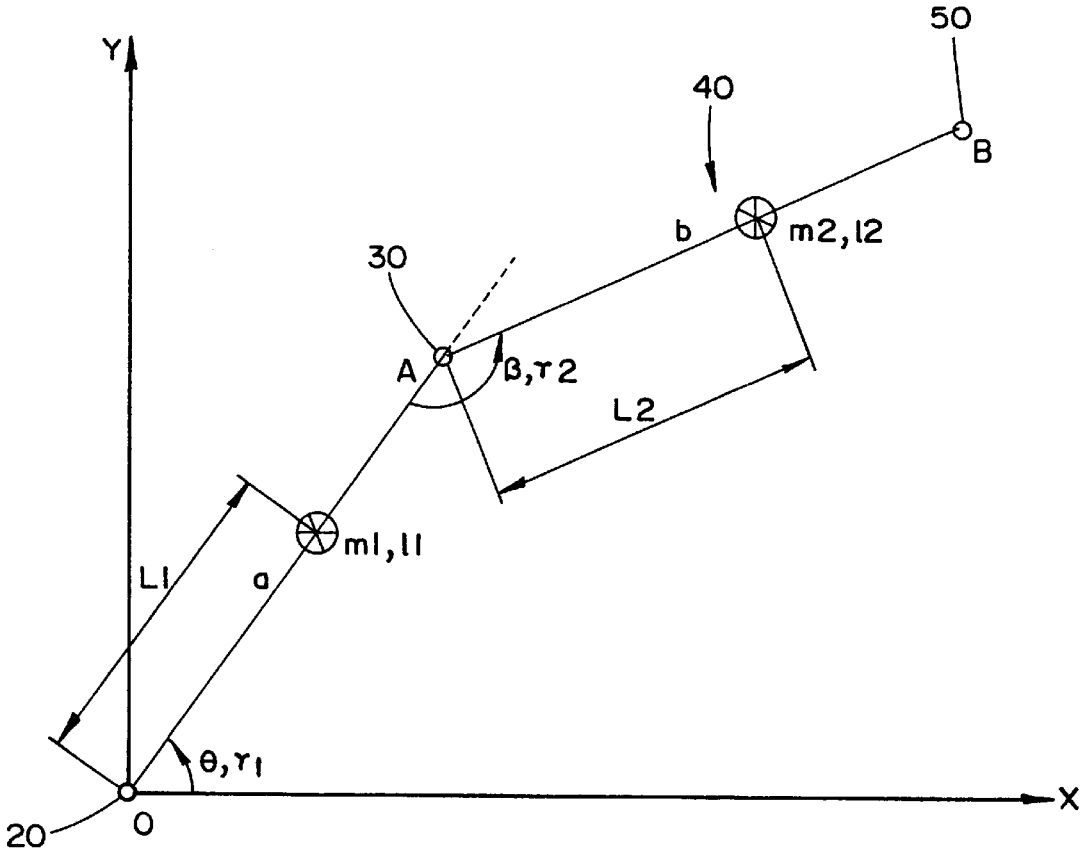
FIG. 1 illustrates a schematic of the shoulder, wrist and golf club for the downswing phase of a golf swing.

Milburn, P. D. "Summation of Segmental Velocities in the Golf Swing," *Medicine and Science in Sports and Exercise*, 14, No. 1, pp. 60–64 (1982), (hereinafter, Milburn) has studied the kinematics of golf swings, presenting a simple, two-degrees-of-freedom model of the arm and the club, as shown in FIG. 1. Milburn also presents a number of motion measurement results. The model presented in FIG. 1 consists of two rigid links with shoulder 20 and wrist 30 joints, with their corresponding joint coordinates (angles) indicated by $\theta$ and $\beta$, respectively. The club 40, having a club head 50, is considered to be rigidly held by the hand. $\Gamma_1$ and $\Gamma_2$ are the net torques produced by the muscle forces about the shoulder 20 and the wrist 30 joints, respectively; "a" is the length of the first link with a moment of inertia $I_1$. and a mass $m_1$ located at a distance $L_1$ from the joint O. The second link length is indicated by "b" and has a moment of inertia $I_2$ and a mass $m_2$ located at a distance $L_2$ from the joint A. It should be noted that the first link OA includes the upper arm and the forearm and that the second link AB includes the golf club 40 and the hand. The above link segment masses and moments of inertia are added to the Milburn model.

For the model presented in FIG. 1, the equations of motion can be readily derived as:

$$\tau_1=[M_1-2\alpha L_2 m_2 \cos\beta]\ddot{\theta}+[M_2-\alpha L_2 m_2 \cos\beta]\ddot{\beta}+2\alpha L_2 m_2 \sin\beta\dot{\theta}\dot{\beta}+\alpha L_2 m_2 \sin\beta\dot{\beta}^2+g[m_1L_1+\alpha m_2]\cos\theta-gm_2L_2\cos(\theta+\beta) \quad (1)$$

$$\tau_2=[M_2-\alpha L_2 m_2 \cos\beta]\ddot{\theta}+M_2\ddot{\beta}-\alpha L_2 m_2 \sin\beta\dot{\theta}^2-gm_2L_2\cos(\theta+\beta) \quad (2)$$

where $$M_1=m_1L_1^2+m_2(\alpha^2+L_2^2)+I_1+I_2$$

Figure 2A:
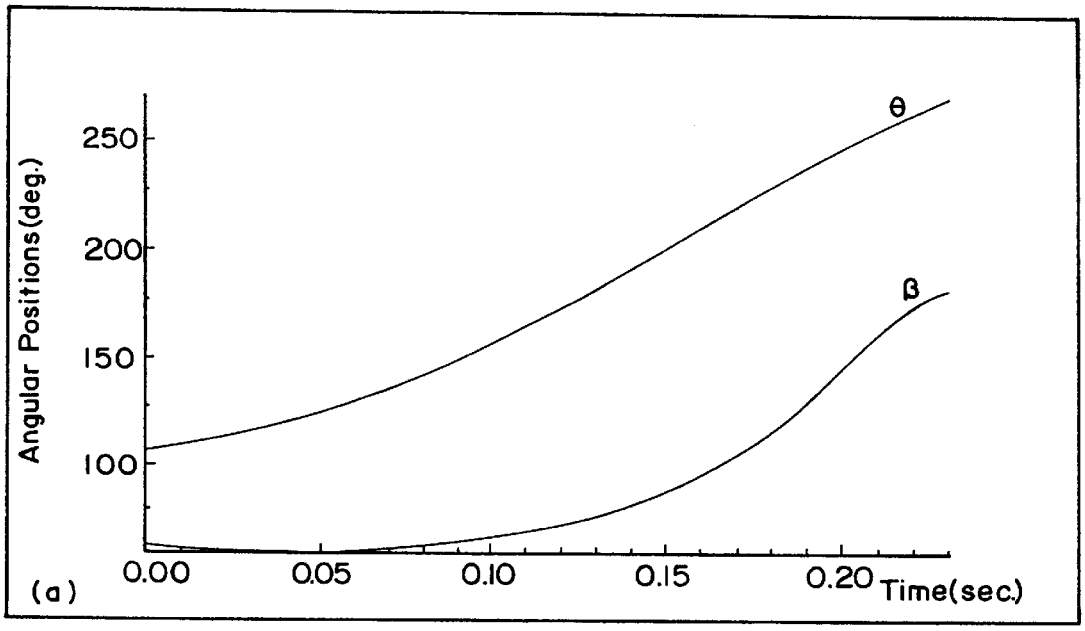
FIG. 2*a* illustrates a graph of the angular positions for the shoulder and wrist as a function of time.
Figure 2B:
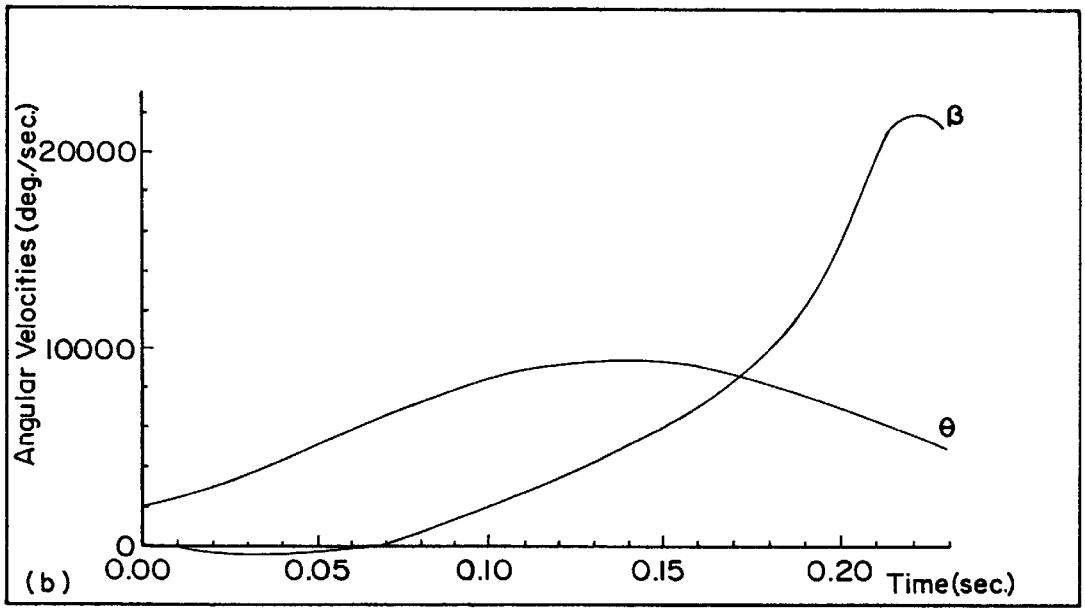
FIG. 2*b* illustrates a graph of the shoulder and wrist velocities as a function of time.

Milburn presented measurements of the time history of wrist and shoulder angles, $\beta$ and $\theta$, during the golf swing of a number of expert players. The data was collected by camera, smoothed and differentiated with respect to time to obtain the corresponding angular velocities (i.e., $\theta$ and $\beta$) and accelerations (i.e., $\theta$ and $\beta$). In FIGS. 2*a* and 2*b*, the angular position and velocity data presented in Milburn is reproduced. The corresponding accelerations $\theta$ and $\beta$ are shown with solid lines in FIG. 3.

Figure 3:
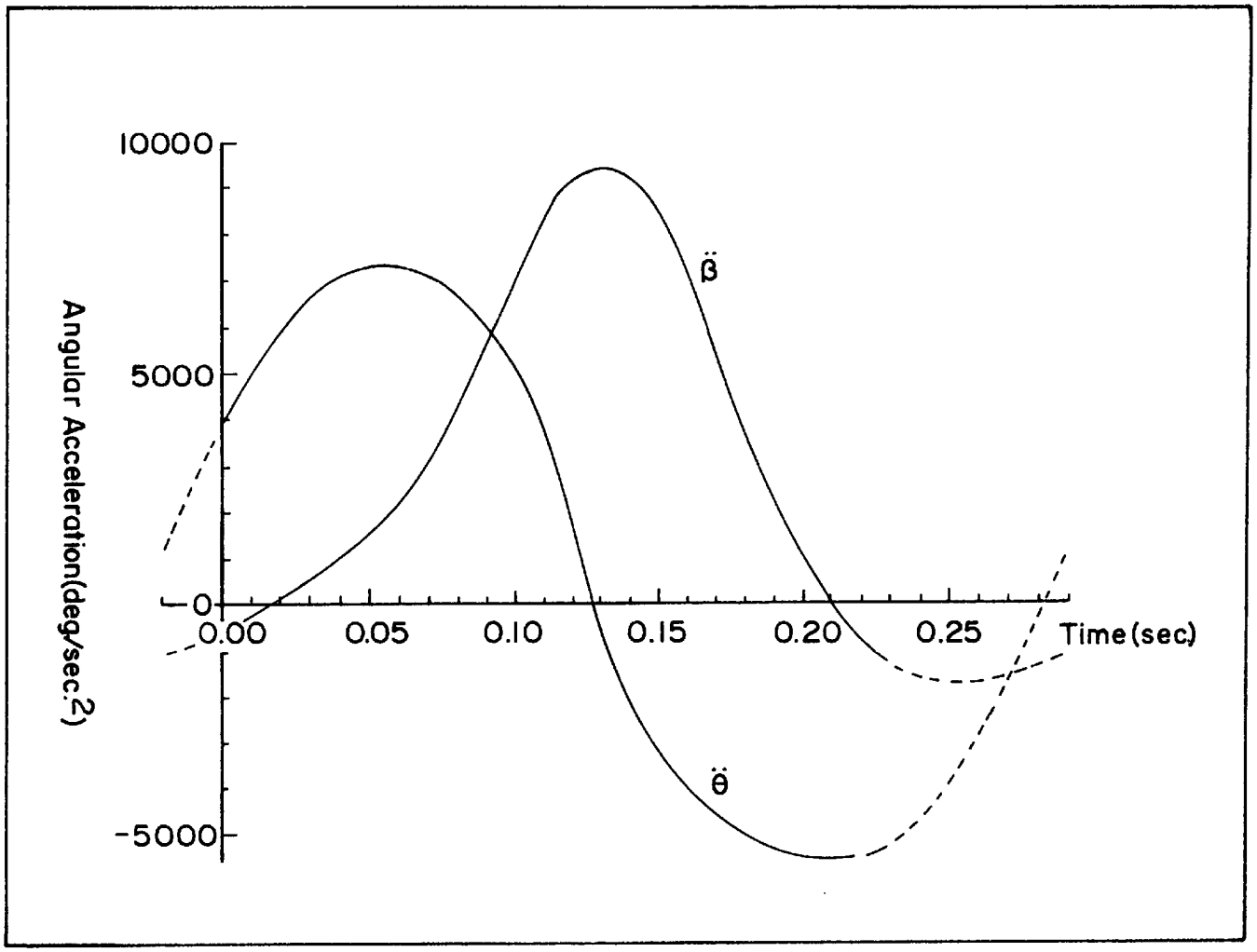
FIG. 3 illustrates a graph of the shoulder and wrist accelerations as a function of time and extended for a full cycle of motion, the extended portions being depicted as dashed lines.
Figure 4A:
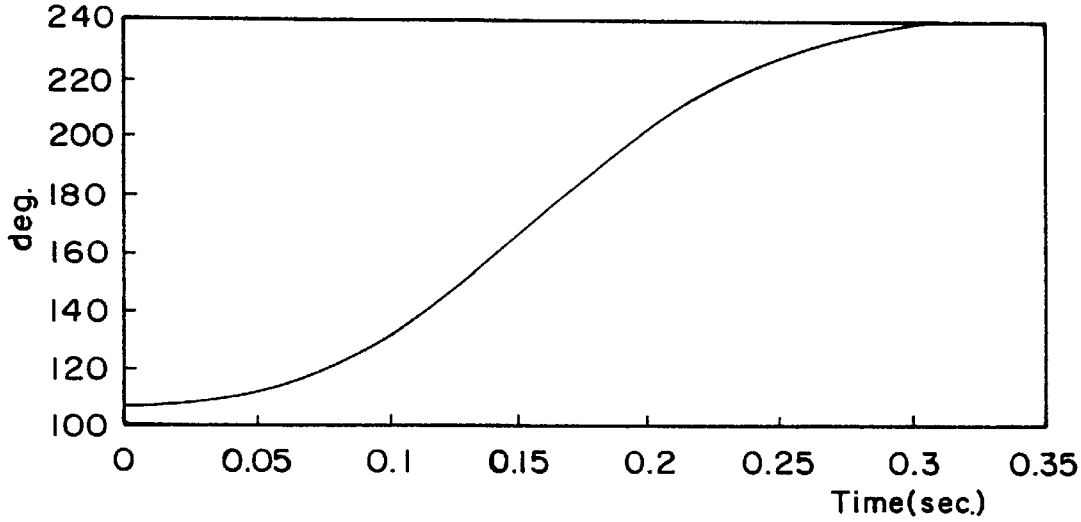
FIGS. 4*a*, 4*b*, and 4*c* illustrate graphs showing the shoulder position, velocity, and acceleration, respectively, for the extended full cycle of motion.
Figure 4B:
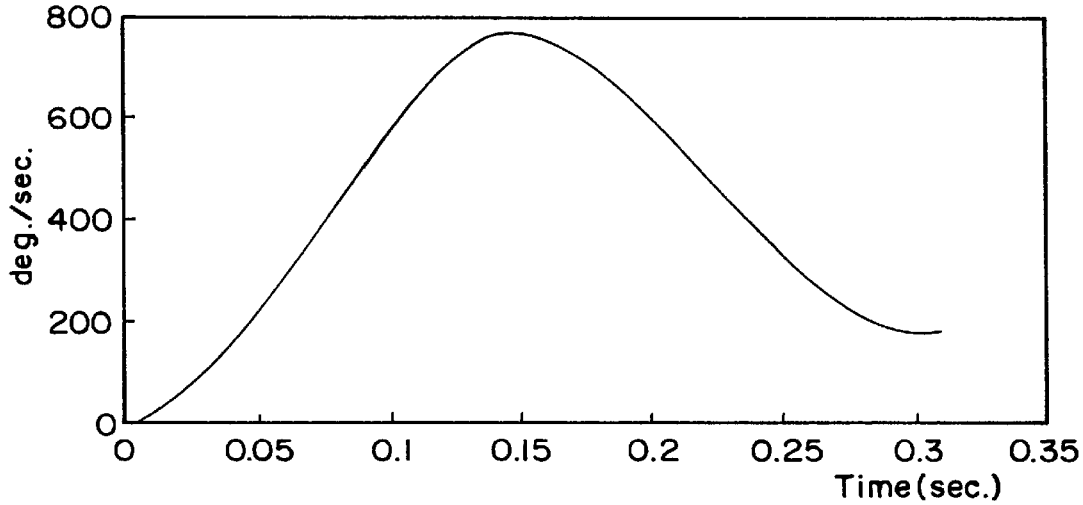
Figure 4C:
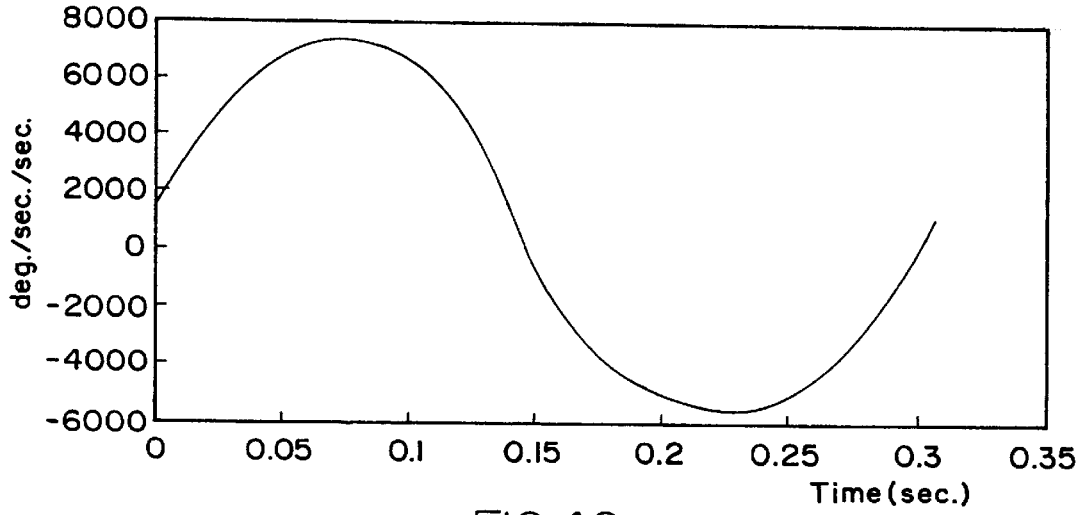
Figure 5A:
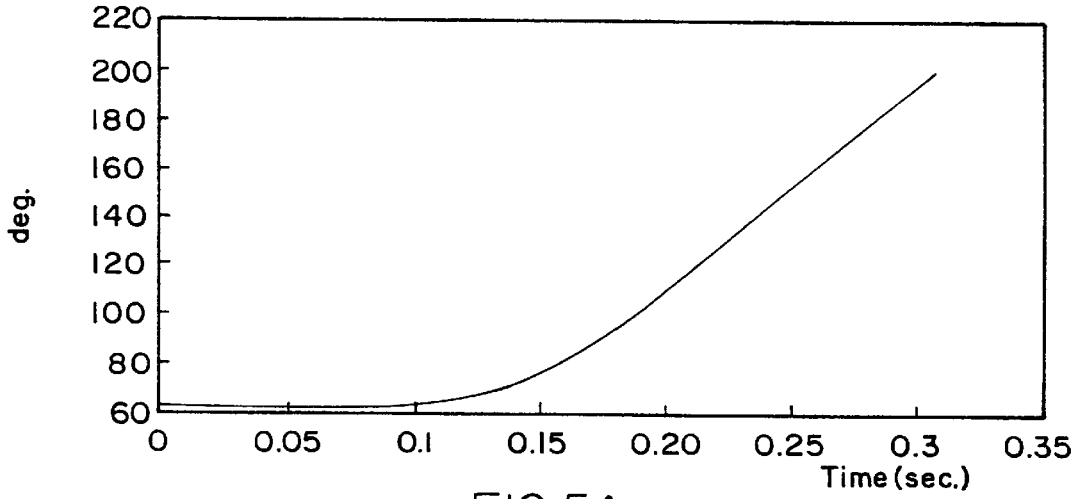
FIGS. 5*a*, 5*b*, and 5*c* illustrate graphs showing the wrist position, velocity, and acceleration, respectively, for the extended full cycle of motion.
Figure 5B:
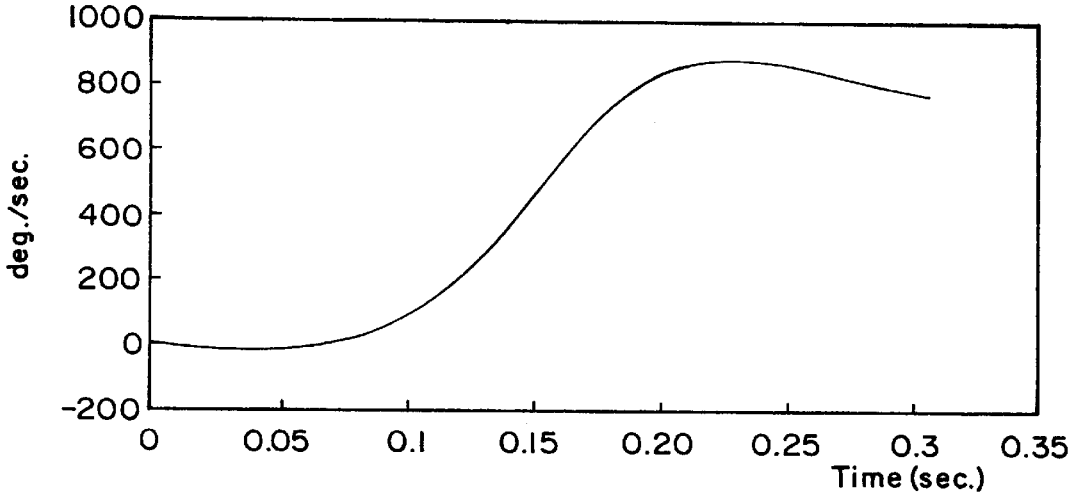
Figure 5C:
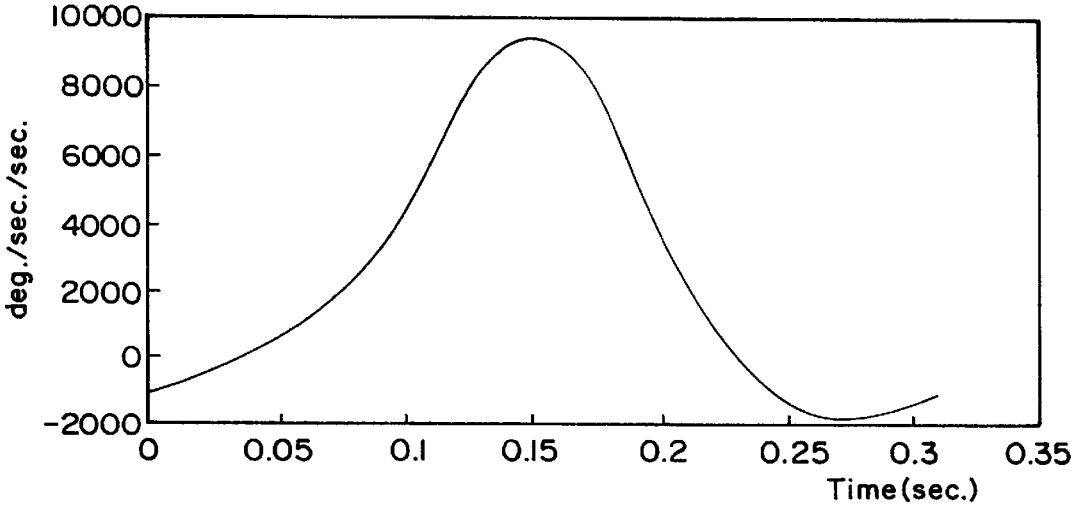

As can be seen in FIG. 2*b*, the data is not collected from the zero velocity position. In the present invention, the measured acceleration data is extended back in time 0.02 seconds to achieve zero velocity and forward 0.6 seconds from the time of ball strike (at time t=0.23 seconds) to construct a full cycle of motion. The extensions are done smoothly and in a manner to match the general measured trend of the curve. The extensions of the acceleration curves are shown in FIG. 3 with dotted lines. The acceleration curves for the full cycle of motion is then integrated to obtain the corresponding velocities and joint positions curves. The resulting acceleration, velocity and joint position curves after zeroing the starting time are shown in FIGS. 4A–4C and 5A–5C for the shoulder angle ($\theta$) and the wrist joint ($\beta$) respectively.

The kinematic parameters (i.e., the lengths "a" and "b" in FIG. 1), and the inertia parameters (i.e., the moment of inertia and mass and the location of the center of mass for each link segment), are not provided in Milburn.

Figure 6:
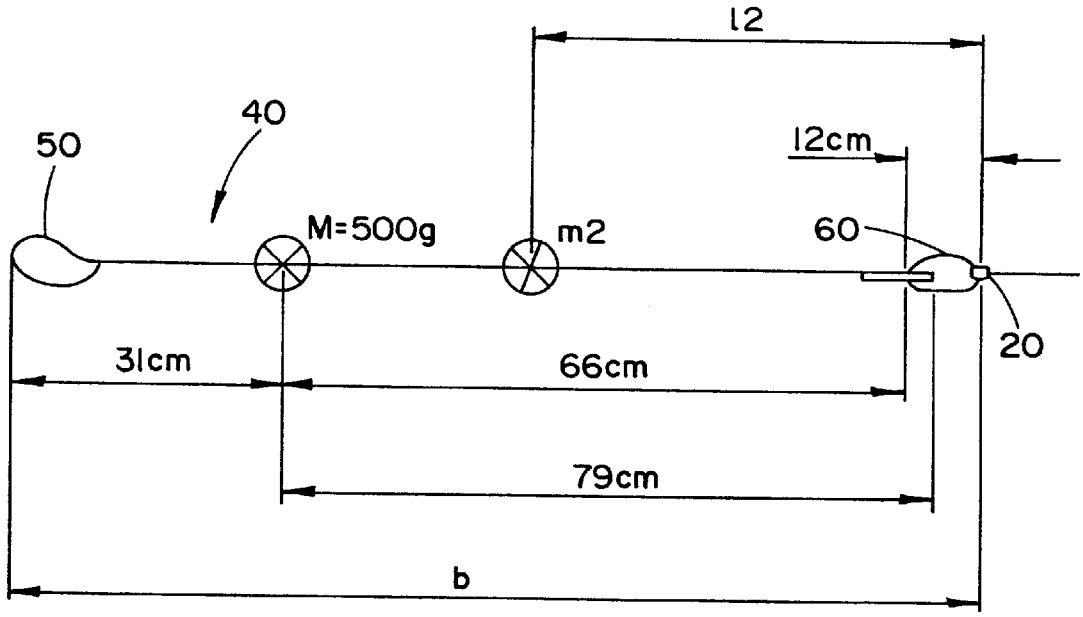
FIG. 6 illustrates the second link of FIG. 1, consisting of the hand, wrist, and golf club.

In the preferred embodiment of the present invention in which a golf swing is analyzed and optimized, the following arm data is taken from winter, D. A. *Biomechanics of Human Movement*, Wiley-Interscience Series, John Wiley & Sons (1979), (hereinafter Winter). For a man 1.80 meter high with a weight of 80 kg, the lengths of the upper arm and the forearm are taken to be 0.362 m and 0.308 m, respectively, with the corresponding masses of 2.24 kg and 1.28 kg. The length of the first segment, FIG. 1, i.e., the length of the upper arm plus the forearm will, therefore, become a=0.676 m with a mass of $m_1$=3.52 kg and distance to the center of mass $L_1$=0.28 m. The corresponding moment of inertia is found from the relationship $I_1=m_1(0.31a)^2$ to be $I_1$=0.152 kg–m$^2$. For the hand 60 and the club 40 segment of the model, as shown in FIG. 6, the total length is taken to be b =1.09 m, with the hand and club lengths as shown in the illustration. The mass of the hand 60 is considered to be $M_h$=0.48 kg and the mass of the club 40 is considered to be $M_c$=0.5 kg, leading to the total mass of the segment to be $m_2$=0.98 kg, located at a distance of $L_2$=0.43 m. The corresponding moment of inertia is readily calculated to be $I_2$=0.152 kg–m$^2$.

It must be noted that the link lengths, link masses and their location along the link lengths and the link moments of inertia are all constant and time invariant. Thus, their actual values do not effectively affect the number of significant harmonics that are found in the joint motions and the joint actuating torques but only their magnitude (amplitudes). Therefore, the conclusions reached are valid even though the selected constants are not totally accurate for the test subjects.

Figure 7A:
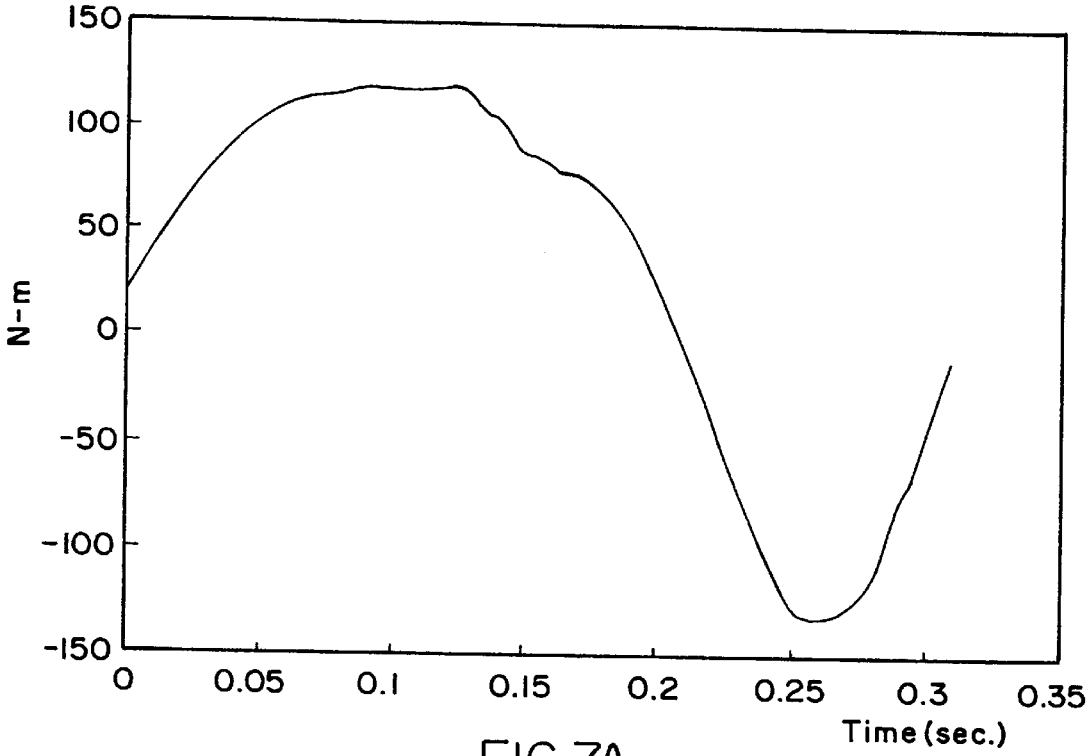
FIGS. 7*a* and 7*b* illustrate the torques generated by the muscle forces of the shoulder and wrist, respectively, as a function of time.
Figure 7B:
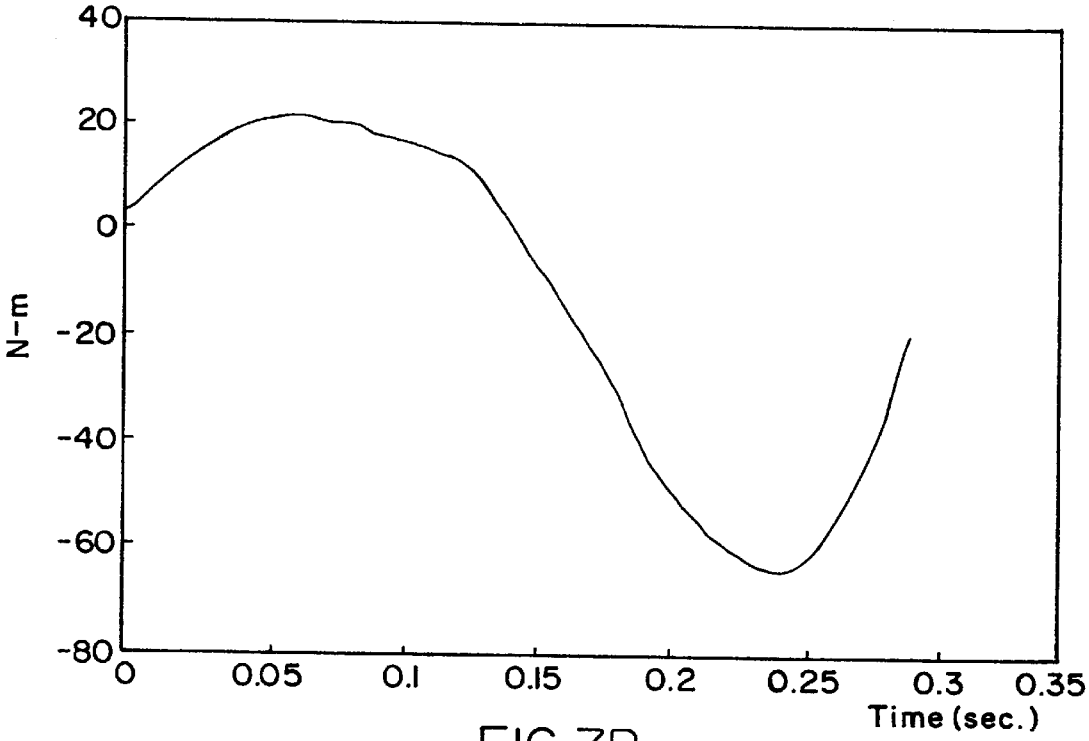

By substituting the above kinematic and inertia parameters and the joint positions, velocities and accelerations shown in FIGS. 4A–4C and 5A–5C into the equations of motion (1) and (2), the joint actuating torques required to achieve the indicated motion, $\tau_1$ and $\tau_2$ are readily calculated as the functions of time and are illustrated in FIGS. 7A and 7B. It should be noted that in our embodiment, the shoulder joint is assumed to be fixed, that is, its absolute velocity and acceleration is zero. However, When a joint is not considered to be fixed, its motion must also be included by incorporating its acceleration and velocity in equations 1 and 2 as is known in the art of dynamics.

Figure 8A:
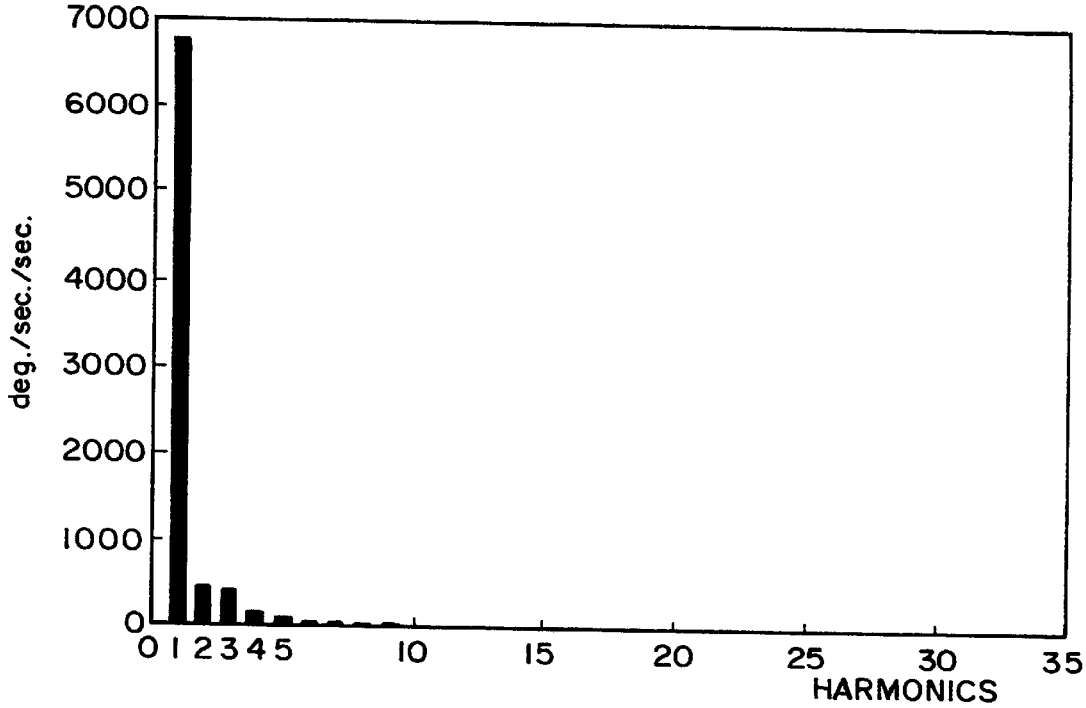
FIGS. 8*a* and 8*b* illustrate the average amplitudes of the harmonics constituting the shoulder and wrist acceleration, respectively.
Figure 8B:
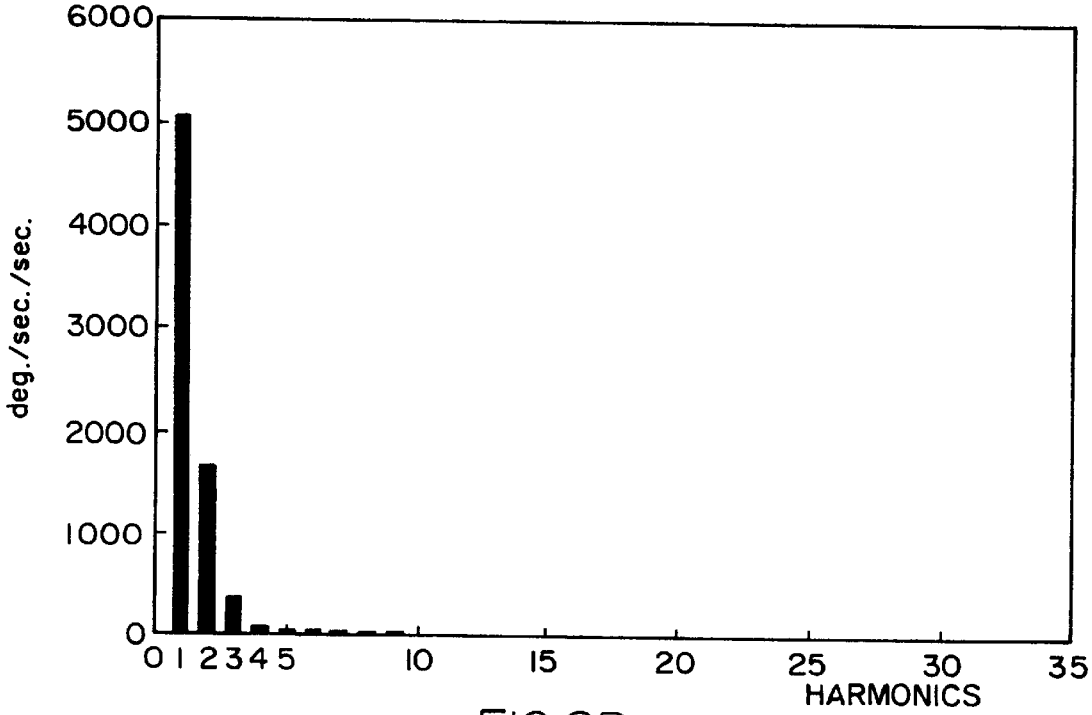
Figure 9A:
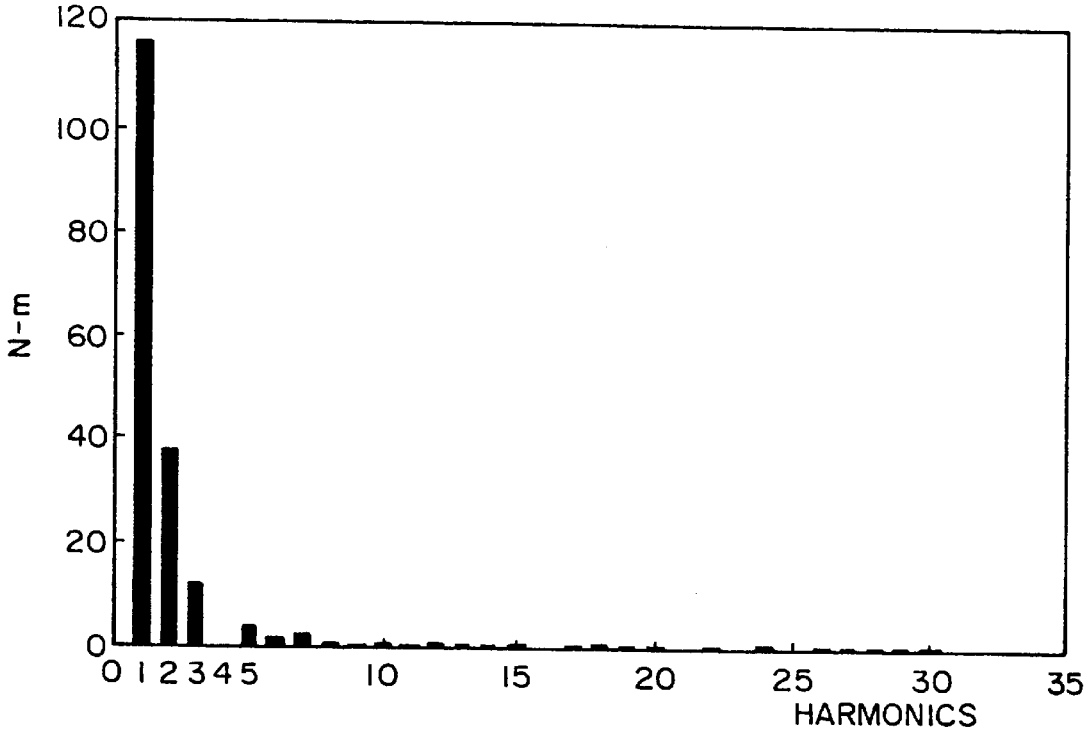
FIGS. 9*a* and 9*b* illustrate the average amplitudes of the harmonics constituting the muscle generating actuating torques of the shoulder and wrist, respectively.
Figure 9B:
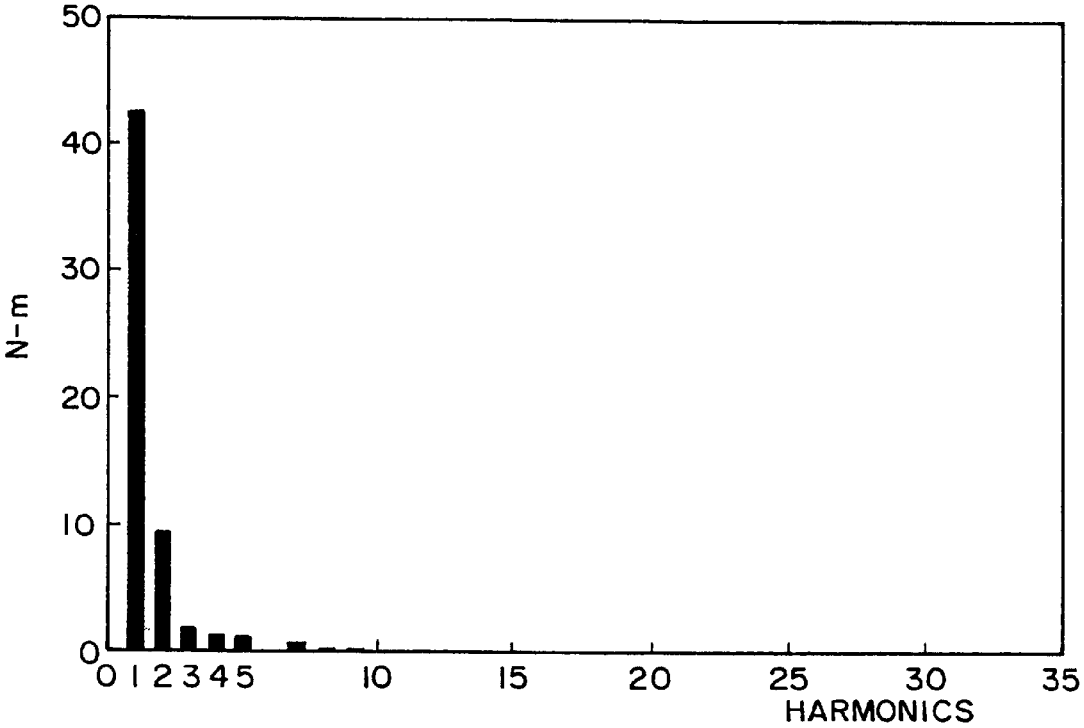

In FIGS. 8A and 8B, the magnitudes of the harmonics that constitute the joint accelerations $\theta$ and $\beta$ are presented. As can be observed in both plots, both shoulder and wrist motions consist almost entirely of the fundamental harmonic with the period of the motion cycle and its first two harmonics with negligible higher harmonics content. The same is shown to be the case for the muscle generated actuating torques $\tau_1$ and $\tau_2$ as shown in FIGS. 9A and 9B. In both amplitude plots, the numbers in the horizontal direction indicate that harmonic (e.g., the 3rd harmonic for the number 3) of the fundamental frequency (first harmonic). In the vertical direction, the square of the magnitude of each harmonic is shown.

The results of the harmonic content analysis of the shoulder and wrist joint motions and the corresponding muscle generated actuating torques presented in this study indicates that both the motions and the actuating torques for golf swings by expert players consist almost entirely of a fundamental harmonic function and its first two harmonics. The results confirm the hypothesis that optimal golf swing motions consist of low harmonic motion patterns that are synthesized to require joint torques with low harmonic content. It should be noted that by requiring the motion to be synthesized with low harmonic content alone does not automatically result in actuating torques with low harmonic (or minimal high harmonic) content. The reason being the nonlinear nature of the dynamics of the shoulder and wrist system as indicated by equations of motion (1) and (2).

Once having determined the type of motion patterns that could lead to optimal golf swing motions, an optimization algorithm can be formulated in which for the given physical parameters of the motion, i.e., the golfer arm and forearm lengths and the associated (approximate) inertia parameters, would synthesize an optimal motion that minimizes the actuating torque harmonics within the available range of muscle forces with which maximum striking velocity could be achieved. The limitation on the harmonic content of the actuating torques are due to the dynamic response limitations of the muscles and the nonlinear nature of the dynamics of the arm.

The developed method can be used for training golfers to improve their golf swings. The method can be seen to be applicable to other sports activities, such as tennis and baseball, and even to sports in which the player does not use any instrument but his hands or legs to hit a ball or perform a similar act.

Figure 10:
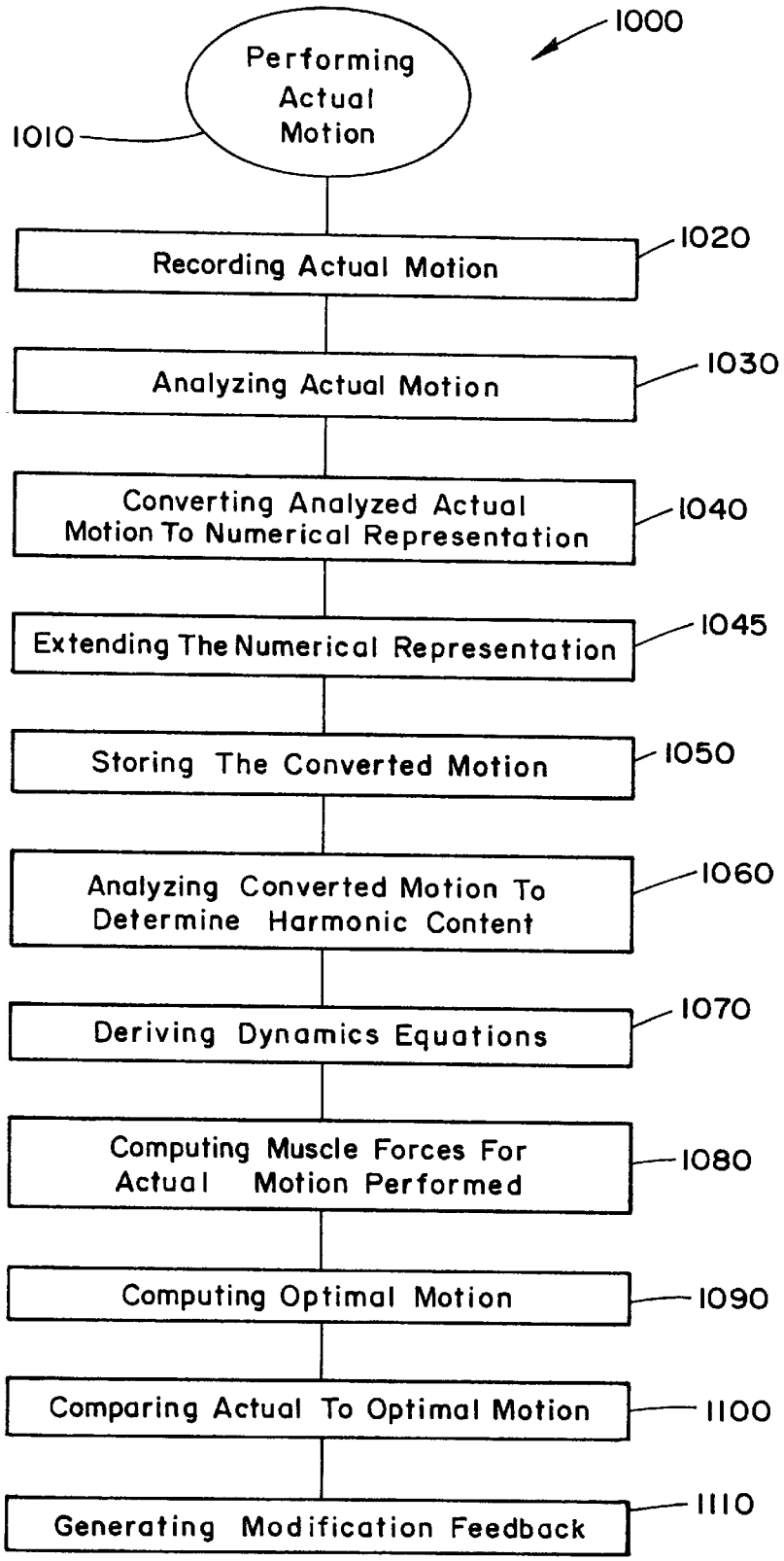
FIG. 10 illustrates a flow diagram of the preferred method of the present invention.

The preferred method for practicing the invention will now be further clarified with regard to FIG. 10 which outlines the steps in said method, the method being referred to generally by reference numeral 1000. The method 1000 is for optimizing an actual motion to perform a desired task by a performer in which the performer has joints connected to body parts. The joints being actuated by muscle forces resulting in body part motion. The actual motion occurring as a result of generated muscle forces which torque the joints, resulting in the actual motion of connective body parts and/or an implement connected thereto. The joints, body parts, implements and their physical characteristics comprise a dynamic system.

The method 1000 in its basic form comprises step 1070 of deriving dynamics equations relating muscle forces to the dynamic behavior of the dynamic system according to equations of motion for the particular dynamic system (e.g., equations (1) and (2) for a golf swing); and computing the optimal motion at step 1090 for performing the desired task by minimizing the higher harmonic content of the muscle forces.

The preferred method 1000 for optimizing and correcting the actual motion comprises performing the actual motion to be analyzed at step 1010 in which each joint in the dynamic system participates in an actual motion. At step 1020 the actual motion is recorded simultaneously with the performance of the motion at step 1010. The actual motion is then analyzed at step 1030 by measuring the joint angles as a function of time. Alternatively, step 1020 can be eliminated if step 1030 is done in real time instead of from the recorded actual motion. The analyzed actual motion is then converted into a numerical representation of joint angle versus time for each joint in the dynamic system at step 1040. Step 1040 can be accomplished by any means known in the art, preferably by using a Fourier analysis to represent the numerical representation in Fourier series.

At step 1045 the numerical representation is extended to form a full period of motion. Preferably, the extended numerical representation is stored at step 1050 for later use. The extended numerical representation is then analyzed at step 1060 to determine the harmonic content for the full period of motion. Dynamics equations are then derived at step 1070 which relate muscle forces to the dynamic behavior of the dynamic system according to the equations of motion for the particular dynamic system. Muscle forces are then computed at step 1080 for the full period of motion according to the equations of motion. The optimal motion for performing the desired task is then computed at step 1090 by minimizing the higher harmonic content of the muscle forces. The actual motion is then compared to the corresponding segment of the optimal motion at step 1100. Lastly, at step 1110, a feedback to the performer is generated in which the performer is instructed and/or prompted on how to modify the actual motion and/or system dynamics (i.e., implement length, weight, etc.) in order to more closely achieve the optimal motion.

Figure 11:
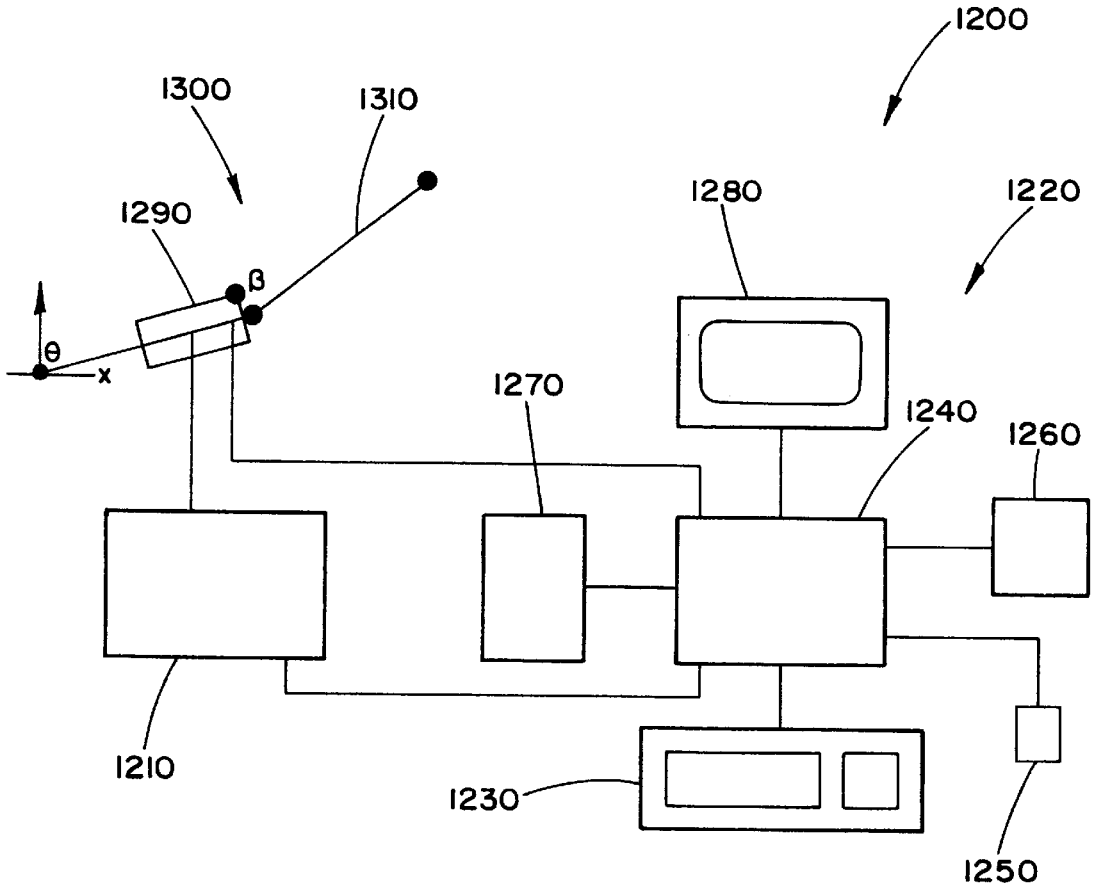
FIG. 11 illustrates the preferred apparatus of the present invention.

An apparatus for carrying out the method of the present invention is shown in FIG. 11. The apparatus, generally referred to by reference numeral 1200, is for 20 optimizing an actual motion to perform a desired task by a performer, where the performer has joints connected to body parts, and where the joints are actuated by muscle forces resulting in body part motion. The actual motion occurs as a result of generated muscle forces which torque the joints, resulting in the actual motion of connective body parts and/or an implement 1310 connected thereto, all of which comprise a dynamic system 1300. The implement 1310 can be a golf club, a baseball bat, a tennis racket, etc.

The apparatus 1200 comprises a means for analyzing the actual motion 1210 to determine the joint angles as a function of time for each joint in the dynamic system. Such systems are well known in the art and include motion recognition and analysis packages which record the movement of dots placed on an article of clothing worn by the performer when performing the actual motion. The recording is then analyzed to determine the movement of the dots with respect to time.

The apparatus further comprises a computing means 1220 for converting the analyzed actual motion into a numerical representation of joint angle versus time for each joint in the dynamic system 1300, for extending the numerical representation to form a full period of motion, for analyzing the extended numerical representation to determine the harmonic content for the full period of motion, for computing muscle forces for the full period of motion according to the equations of motion for the particular dynamic system, for computing the optimal motion for performing the desired task by minimizing the higher harmonic content of the muscle forces, for comparing the actual motion to the corresponding segment of the optimal motion, and for generating a feedback signal instructing and/or prompting the performer how to modify the actual motion and/or system dynamics in order to more closely achieve the optimal motion. Typically, such a computing means 1220 comprises a personal computer (PC) having an input device 1230, such as a keyboard, a CPU 1240, a pointing device 1250, such as a mouse, memory 1260, and an output means 1280, such as a printer and monitor.

The PC 1220 analyzes the motion and using the approximate physical characteristics of the athlete, determines the motion that would lead to maximum performance according to the method of the present invention. The resulting information is then communicated to the performer.

Alternatively, the output device of the PC 1280 can be utilized for receiving the generated feedback signal from the computing means 1220 for generating feedback forces to at least one of the joints in the dynamic system while performing an actual motion for more closely obtaining the optimal motion. In this configuration the monitor, or any other output device 1280, can be used to superimpose the optimal motion over the actual motion so the performer can visualize the modification to the actual motion.

The monitor 1280 can also be used in a number of other ways. The actual motions at the relevant joints and the required modifications, both in the range of the joint motion and in the pattern of motion, can be displayed on the monitor. The information can also indicate which muscles must be used more forcefully.

Alternatively, the apparatus 1200 can also comprise a feedback device 1290 receiving the generated feedback signal from the computing means 1220 for generating feedback forces to at least one of the joints in the dynamic system while performing an actual motion for more closely obtaining the optimal motion. The joint and muscle information can also be provided to the aforementioned feedback devices 1290 that are mounted at the appropriate joints to aid the athlete in his/her training by providing feedback indicating whether he/she is moving/pushing too fast/hard or otherwise.

Preferably, a recording means 1270 is also provided. Preferably, the recording means consists of one or more, preferably two, high speed cameras which record the actual motion of the athlete while performing his/her desired task.

The entire information can be stored and used over time to train the performer or to plot the performer's progress. The recorded motion information and the optimal motion planning software can also be used to achieve a number of other aims. For example, the analysis would show whether the athlete is overloading (or overextending) one of his/her joints or muscles and, if so, how to avoid that without degrading his/her performance or even at the same time increasing his/her performance. The training system can also be used to determine which muscles need to be strengthened to increase performance or to prevent injury (or further injury) to a joint or a muscle.

The feedback device 1290 is preferably a "wet suit" like shoulder, elbow, wrist, knee, ankle, hip, back and/or neck device that is instrumented and firmly held in place as a segment of a wet suit would on the desired segment of the body. The feedback device can consist of one or both of the following.

The feedback device 1290 can be instrumented only for measuring the joint motion and relaying the information to the computing means for comparison and feedback to the performer for motion modification.

Alternatively, the feedback device can be equipped with a (motion) "resistance" generating "actuator" such as one constructed with smart materials, such as piezoceramic films and/or smart fluids that are used to feedback a resistive (or a positive) force to the user that indicates whether he should slow down the joint motion or increase its rate of motion depending on the direction of the resistive force. The resistive force will act similarly to a power brake for an automobile by providing a feedback force. The feedback force provides the performer to "tune up" his/her motion for optimal performance according to the optimal motions determined by the computing means, and as generated by the method of the present invention. Preferably, the feedback force is less than and proportional to a force needed to achieve the optimal motion.

It should be understood to those in the art that the present invention has utility not only in analyzing physical performance relating to athletic activities, but for purposes such as joint and muscle injury prevention, physical therapy, etc. The calculated joint motions can be used (either by an examining physician or by software) to determine how the motion needs to be modified, to modify joint or muscle forces for injury prevention, to perform physical therapy for a previously injured person, or to permit an already injured or healing player to play without further injury. The present invention even has utility to determine and plan the proper exercise for a player to strengthen certain muscle forces that would help to improve performance in his or her particular activity or utilized by a physician or physical therapist to build proper joint supports or constraints to accomplish the above. Lastly, the present invention can be enabled to provide a warning or feedback signal to signify when injury or further injury is imminent.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for optimizing an actual motion to perform a desired task by a performer, the performer having joints connected to body parts, the joints being actuated by muscle forces resulting in body part motion, the actual motion occurring as a result of generated muscle forces which torque the joints, resulting in the actual motion of connective body parts and/or an implement connected thereto, all of which comprise a dynamic system, the method comprises the steps of:

(a) deriving dynamics equations relating muscle forces to the dynamic behavior of the dynamic system; and (b) computing the optimal motion for performing the desired task by minimizing the higher harmonic content of the muscle forces.

2. A method for optimizing an actual motion to perform a desired task by a performer, the performer having joints connected to body parts, the joints being actuated by muscle forces resulting in body part motion, the actual motion occurring as a result of generated muscle forces which torque the joints, resulting in the actual motion of connective body parts and/or an implement connected thereto, all of which comprise a dynamic system, the method comprises the steps of:

(a) performing the actual motion to be analyzed in which each joint in the dynamic system participates in the actual motion;

(b) analyzing the actual motion by measuring the joint angles and absolute joint positions as a function of time;

(c) converting the analyzed actual motion into a numerical representation of joint angle and absolute joint position versus time for each joint in the dynamic system;

(d) extending the numerical representation to form a full period of motion;

(e) analyzing the extended numerical representation to determine the harmonic content for the full period of motion;

(f) deriving dynamics equations relating muscle forces to the dynamic behavior of the dynamic system according to equations of motion;

(g) computing muscle forces for the full period of motion using the equations of motion;

(h) computing the optimal motion for performing the desired task by minimizing the higher harmonic content of the muscle forces; and (i) comparing the actual motion to the optimal motion.

3. The method of claim 2, further comprising the step of generating a feedback to the performer instructing the performer how to modify the actual motion and/or system dynamics in order to more closely achieve the optimal motion.

4. The method of claim 2, further comprising the step of recording the actual motion simultaneous with the performing step for eliminating the need to analyze the actual motion in real time.

5. The method of claim 2, further comprising the step of storing the numerical representation after it is converted for later use.

6. An apparatus for optimizing an actual motion to perform a desired task by a performer, the performer having joints connected to body parts, the joints being actuated by muscle forces resulting in body part motion, the actual motion occurring as a result of generated muscle forces which torque the joints, resulting in the actual motion of connective body parts and/or an implement connected thereto, all of which comprise a dynamic system, the apparatus comprising:

a means for analyzing the actual motion to determine the joint angles and absolute joint positions as a function of time for each joint in the dynamic system; and a computing means for converting the analyzed actual motion into a numerical representation of joint angle and absolute joint position versus time for each joint in the dynamic system, for analyzing the numerical representation to determine the harmonic content for the full period of motion, for computing muscle forces for the actual motion using equations of motion, for computing the optimal motion for performing the desired task by minimizing the higher harmonic content of the muscle forces, and for comparing the actual motion to the optimal motion.

7. The apparatus of claim 6, wherein the computing means also generates a modification feedback signal instructing the performer how to modify the actual motion and/or system dynamics in order to more closely achieve the optimal motion.

8. The apparatus of claim 7, further comprising a feedback device receiving the generated feedback signal from the computing means for generating modification forces instructing the performer how to modify the actual motion for at least one of joint in the dynamic system while performing an actual motion for more closely obtaining the optimal motion.

9. The apparatus of claim 8, wherein the modification force is less than and proportional to a force needed to achieve the optimal motion.

10. The apparatus of claim 6, further comprising an output device for superimposing an optimal motion over the actual motion.

11. The apparatus of claim 10, wherein the output device is a monitor.

12. The apparatus of claim 6, further comprising a recording means for recording the actual motion and thereby eliminating the need to analyze the actual motion in real time.

13. The apparatus of claim 12, wherein the recording means comprises at least one high speed camera for recording the actual motion of the performer.

* * * * *